US010851723B2

(12) United States Patent
Wodausch et al.

(10) Patent No.: US 10,851,723 B2
(45) Date of Patent: Dec. 1, 2020

(54) METHOD FOR OPERATING AN INTERNAL COMBUSTION ENGINE, AND INTERNAL COMBUSTION ENGINE

(71) Applicant: VOLKSWAGEN AKTIENGESELLSCHAFT, Wolfsburg (DE)

(72) Inventors: Jens Wodausch, Braunschweig (DE); Björn Fröhlich, Gifhorn (DE)

(73) Assignee: VOLKSWAGEN AKTIENGESELLSCHAFT, Wolfsburg (DE)

( * ) Notice: Subject to any disclaimer, the term of this patent is extended or adjusted under 35 U.S.C. 154(b) by 0 days.

(21) Appl. No.: 16/357,697

(22) Filed: Mar. 19, 2019

(65) Prior Publication Data

US 2019/0293008 A1 Sep. 26, 2019

(30) Foreign Application Priority Data

Mar. 20, 2018 (DE) ..... 10 2018 106 441

(51) Int. Cl.
*F02D 41/00* (2006.01)
*F02M 25/08* (2006.01)

(52) U.S. Cl.
CPC ..... *F02D 41/0042* (2013.01); *F02D 41/004* (2013.01); *F02M 25/0836* (2013.01);
(Continued)

(58) Field of Classification Search
CPC ..... F02D 41/0042; F02D 41/004; F02D 41/1454; F02D 41/221; F02D 41/2438;
(Continued)

(56) References Cited

U.S. PATENT DOCUMENTS 6,227,177 B1 * 5/2001 Yamafuji ..... F02D 41/0042 123/399
2004/0226543 A1 11/2004 Penschuck
2009/0084084 A1 4/2009 Mai et al.
2009/0088953 A1 * 4/2009 Mai ..... F02D 41/0042 701/104
(Continued)

FOREIGN PATENT DOCUMENTS

DE 102 52 225 A1 5/2004
DE 10 2007 046 481 B3 4/2009
(Continued)

OTHER PUBLICATIONS

Search report for German Patent Application No. 10 2018 106 441.1, dated May 11, 2018.

*Primary Examiner* — George C Jin
(74) *Attorney, Agent, or Firm* — Pearl Cohen Zedek Latzer Baratz LLP

(57) ABSTRACT

A method for operating an internal combustion engine, which includes at least a combustion engine, a fresh gas line and a fuel tank system. The fuel tank system includes a fuel tank, a fuel vapor filter, a purge gas line that connects the fuel vapor filter to the fresh gas line, and a sensor that is suited for determining a degree of hydrocarbon saturation of purge gas contained in the purge gas line. The fuel tank system also has a tank ventilation valve that is integrated in the purge gas line and/or a purge-gas feed device. In response to a control device, a tank ventilation process is initiated, as needed, for which the purge-gas feed device is operated, and/or the tank ventilation valve is opened; for the tank ventilation process, a hydrocarbon content of the purge gas being ascertained using the sensor. A quantity of fuel to be introduced into at least a combustion chamber of the combustion engine is then adjusted as a function of the ascertained hydrocarbon content. The hydrocarbon content is thereby continuously determined during the tank ventila-
(Continued)

tion process and is utilized to actuate the tank ventilation valve and/or the purge-gas feed device.

17 Claims, 5 Drawing Sheets

(52) U.S. Cl.
CPC ... *F02M 25/0872* (2013.01); *F02D 2200/021* (2013.01); *F02D 2200/0611* (2013.01); *F02D 2200/70* (2013.01)

(58) Field of Classification Search
CPC ..... F02D 41/2454; F02D 41/0045; F02D 2200/0611; F02D 2200/021; F02D 2200/70; F02M 25/0872; F02M 25/0836; F02M 25/089
See application file for complete search history.

(56) References Cited

U.S. PATENT DOCUMENTS

| | | | | |
|---|---|---|---|---|
| 2016/0025019 | A1* | 1/2016 | Pearce | F02M 25/0836 123/520 |
| 2016/0123254 | A1 | 5/2016 | Burleigh et al. | |
| 2016/0312718 | A1* | 10/2016 | Dudar | F02D 41/021 |
| 2017/0260931 | A1* | 9/2017 | Guidi | F02M 26/20 |
| 2018/0023497 | A1* | 1/2018 | Dudar | F02D 41/222 701/103 |

FOREIGN PATENT DOCUMENTS

| | | | |
|---|---|---|---|
| DE | 10 2007 046 482 | A1 | 4/2009 |
| DE | 10 2011 015 998 | A1 | 10/2012 |
| DE | 10 2015 117 050 | A1 | 5/2016 |
| DE | 10 2015 216 504 | A1 | 3/2017 |
| WO | WO 2012/049230 | A1 | 4/2012 |

* cited by examiner

| HC | -10s | 0s | 2s | 2.1s | 2.5s | 3s | 3.2s | 10s |
|---|---|---|---|---|---|---|---|---|
| 0 | 0 | 2 | 3 | 1 | 0 | 0 | 0 | 0 |
| + | 0 | 2 | 3 | 1 | 0 | 0 | 0 | 0 |
| ++ | 0 | 2 | 3 | 3 | 1 | 0 | 0 | 0 |
| +++ | 0 | 2 | 3 | 3 | 1 | 0 | 0 | 0 |
| ++++ | 0 | 2 | 3 | 3 | 2 | 1 | 0 | 0 |

| HC | -10s | 0s | 2s | 2.1s | 2.5s | 3s | 3.2s | 10s |
|---|---|---|---|---|---|---|---|---|
| 0 | 2 | 0 | 0 | 0 | 0 | 0 | 0 | 0 |
| + | 2 | 0 | 0 | 0 | 0 | 0 | 0 | 0 |
| ++ | 2 | 0 | 0 | 2 | 4 | 3 | 1 | 0 |
| +++ | 2 | 0 | 2 | 4 | 4 | 3 | 1 | 0 |
| ++++ | 2 | 0 | 2 | 4 | 4 | 3 | 1 | 0 |

| HC | -10s | 0s | 2s | 2.1s | 2.5s | 3s | 3.2s | 10s |
|---|---|---|---|---|---|---|---|---|
| 0 | 1 | 1 | 1 | 1 | 1 | 1 | 1 | 1 |
| + | 1 | 1 | 1 | 1 | 1 | 1 | 1 | 1 |
| ++ | 1 | 2 | 2 | 2 | 2 | 2 | 1 | 1 |
| +++ | 1 | 2 | 2 | 3 | 3 | 3 | 2 | 1 |
| ++++ | 1 | 2 | 2 | 3 | 3 | 3 | 2 | 1 |

t

| HC | -10s | 0s | 2s | 2.1s | 2.5s | 3s | 3.2s | 10s |
|---|---|---|---|---|---|---|---|---|
| 0 | 0 | 3 | 3 | 3 | 3 | 3 | 3 | 3 |
| + | 0 | 3 | 3 | 3 | 3 | 3 | 3 | 3 |
| ++ | 0 | 3 | 3 | 3 | 3 | 3 | 3 | 3 |
| +++ | 0 | 3 | 3 | 3 | 3 | 3 | 3 | 3 |
| ++++ | 0 | 3 | 3 | 3 | 3 | 3 | 3 | 3 |

| HC | -10s | 0s | 2s | 2.1s | 2.5s | 3s | 3.2s | 10s |
|---|---|---|---|---|---|---|---|---|
| 0 | 2 | 0 | 0 | 0 | 0 | 0 | 0 | 0 |
| + | 2 | 2 | 2 | 2 | 2 | 2 | 2 | 2 |
| ++ | 2 | 2 | 2 | 2 | 2 | 2 | 2 | 2 |
| +++ | 2 | 2 | 5 | 5 | 5 | 5 | 2 | 0 |
| ++++ | 0 | 2 | 5 | 5 | 5 | 2 | 0 | 0 |

| HC | -10s | 0s | 2s | 2.1s | 2.5s | 3s | 3.2s | 10s |
|---|---|---|---|---|---|---|---|---|
| 0 | 1 | 1 | 1 | 1 | 1 | 1 | 1 | 1 |
| + | 1 | 3 | 3 | 3 | 3 | 3 | 3 | 3 |
| ++ | 1 | 3 | 3 | 3 | 3 | 3 | 3 | 3 |
| +++ | 1 | 3 | 3 | 3 | 3 | 3 | 1 | 0 |
| ++++ | 1 | 3 | 3 | 3 | 3 | 1 | 0 | 0 |

FIG. 3 t

| HC | -10s | 0s | 2s | 2.1s | 2.5s | 3s | 3.2s | 10s |
|---|---|---|---|---|---|---|---|---|
| 0 | 0 | 3 | 3 | 3 | 2 | 0 | 0 | 0 |
| + | 0 | 3 | 3 | 3 | 2 | 0 | 0 | 0 |
| ++ | 0 | 3 | 3 | 3 | 2 | 0 | 0 | 0 |
| +++ | 0 | 3 | 3 | 3 | 2 | 0 | 0 | 0 |
| ++++ | 0 | 3 | 3 | 3 | 2 | 0 | 0 | 0 |

| HC | -10s | 0s | 2s | 2.1s | 2.5s | 3s | 3.2s | 10s |
|---|---|---|---|---|---|---|---|---|
| 0 | 2 | 0 | 0 | 0 | 0 | 0 | 0 | 0 |
| + | 2 | 0 | 0 | 2 | 4 | 4 | 4 | 0 |
| ++ | 2 | 0 | 0 | 2 | 4 | 4 | 4 | 0 |
| +++ | 2 | 0 | 0 | 2 | 4 | 4 | 2 | 0 |
| ++++ | 2 | 0 | 0 | 2 | 4 | 2 | 0 | 0 |

| HC | -10s | 0s | 2s | 2.1s | 2.5s | 3s | 3.2s | 10s |
|---|---|---|---|---|---|---|---|---|
| 0 | 1 | 1 | 1 | 1 | 1 | 1 | 1 | 0 |
| + | 1 | 1 | 2 | 2 | 3 | 3 | 3 | 0 |
| ++ | 1 | 1 | 2 | 2 | 3 | 3 | 3 | 0 |
| +++ | 1 | 1 | 2 | 2 | 3 | 3 | 1 | 0 |
| ++++ | 1 | 1 | 2 | 2 | 3 | 1 | 0 | 0 |

FIG. 4

METHOD FOR OPERATING AN INTERNAL COMBUSTION ENGINE, AND INTERNAL COMBUSTION ENGINE

This application claims priority from German Patent Application No. 10 2018 106 441.1, filed Mar. 20, 2018, which is incorporated herein by reference in its entirety.

FIELD OF THE INVENTION

The present invention relates to a method for operating an internal combustion engine having a fuel tank system equipped with a system for evaporative emission control. The present invention also relates to an internal combustion engine suited for implementing such a method.

BACKGROUND OF THE INVENTION

Normally, a fuel tank system for an internal combustion engine of a motor vehicle has a vent line for relieving to the ambient environment a pressure rising in the fuel tank of the tank system caused, for example, by fuel that is vaporizing at high ambient temperatures. To the extent possible, fuel vapors are not to be released into the ambient environment, also because of emission regulations. The vent line leading into a fuel vapor filter prevents this. It is normally in the form of an activated-carbon filter and absorbs the fuel vapors.

To regenerate the fuel vapor filter, such a tank system is additionally provided with a purge gas line, which is connected at one end to the fuel vapor filter and, at the other end, to the fresh gas line of the internal combustion engine. During operation of the internal combustion engine, ambient air can be drawn in periodically by the partial vacuum prevailing in the area of the purge gas line orifice in the fresh gas line via an ambient orifice of the fuel vapor filter. Its flow traverses the fuel vapor filter in the direction opposite that of the fuel vapor flow from the fuel tank into the fuel vapor filter, and thereby purges the same. The fuel vapors from the fuel vapor filter are thereby delivered by the fresh gas line to the combustion chambers of the combustion engine of the internal combustion engine.

The German Patent Application DE 10 2011 015 998 A1 describes a method for determining a degree of saturation of an activated-carbon filter for gaseous hydrocarbons originating from a fuel tank of a motor vehicle, where a pressure prevailing in the fuel tank is recorded. At least one quantity, preferably a volumetric flow rate through a vent line or a frequency of an actuation of a shut-off valve, is ascertained on the basis of the recorded pressure. The quantity is used to determine the activated-carbon filter's degree of saturation with gaseous hydrocarbons.

The German Patent Application DE 102 52 225 A1 describes a method for determining the fuel vapor pressure in a fuel tank system of a motor vehicle equipped with an evaporative emission control system.

The World Patent Application WO 2012/049230 A1 describes a method for operating an internal combustion engine, which includes at least a cylinder, an exhaust-system branch having a measuring device, in particular a lambda probe, as well as an evaporative emission control system having a purge-air line. The purge-air line is configured between the evaporative emission control system and the at least one cylinder for purposes of pneumatic communication. The purge-air line has at least one sensor, in particular a temperature sensor or mass-flow sensor, for determining a hydrocarbon content of a gas stream. A hydrocarbon content of a gas stream flowing from the evaporative emission control system to the at least one cylinder is determined as a function of a measurement signal from the sensor. Furthermore, a fuel metering into the at least one cylinder is controlled as a function of the ascertained hydrocarbon content. In addition, an exhaust gas parameter of an exhaust stream, which flows in the exhaust-system branch, is recorded by the measuring device and compared to a predefined setpoint value. If the ascertained differential amount between the recorded exhaust gas parameter and the predefined setpoint value exceeds a predefined limit value, it is checked whether the sensor has a malfunction.

SUMMARY OF THE INVENTION

It is an object of the present invention to provide an improved method for operating an internal combustion engine having a fuel tank system equipped with an evaporative emission control system.

This objective is achieved by a method as set forth in the claims. An internal combustion engine suited for implementing such a method constitutes the subject matter of the claims. Advantageous specific embodiments of the method of the present invention and preferred embodiments of the internal combustion engine according to the present invention constitute the subject matters of the further claims and/or are derived from the following description of the present invention.

The present invention provides a method for operating an internal combustion engine, which includes at least a combustion engine, a fresh gas line and a fuel tank system. The fuel tank system includes at least a fuel tank, a fuel vapor filter, a purge gas line that connects the fuel vapor filter to the fresh gas line, and (at least) one sensor that is suited, respectively adapted for directly or indirectly determining a degree of hydrocarbon saturation of purge gas contained in the purge gas line. The fuel tank system also features a tank ventilation valve that is integrated in the purge gas line, i.e., a dosing unit of virtually any design, which may be used to quantitatively influence purge gas passing from the purge gas line into the fresh gas line, and/or features a purge-gas feed device. In response to a control device of the internal combustion engine that is connected by control technology to the tank ventilation valve and/or the purge-gas feed device, a tank ventilation process is initiated, as needed, for which the purge-gas feed device is at least periodically operated, and/or the tank ventilation valve is at least periodically and at least partially opened; for the tank ventilation process, a hydrocarbon content of the purge gas being ascertained using the sensor. A quantity of fuel to be introduced into at least one combustion chamber of the combustion engine is then adjusted as a function of the ascertained hydrocarbon content. Such a method is characterized by the hydrocarbon content being continuously determined during the tank ventilation process, i.e., for the entire time period of the tank ventilation process and used for actuating the tank ventilation valve and/or the purge-gas feed device. The hydrocarbon content may thereby be continuously determined in a preferably uninterrupted process, respectively on the basis of each measurement signal from the sensor. Also possible, however, is a repeated determination over the entire time period of the tank ventilation process with interposed interruptions.

The inventive procedure makes possible a much more precise adaptation of the fuel quantity to be introduced into the combustion chamber(s), and thus for the operation of the combustion engine to be optimized during a tank ventilation process, particularly with regard to pollutant emissions, since the response to a change in the hydrocarbon content in the purge gas essentially takes place in real time and may be considered during fuel quantity adjustment. This constitutes a substantial advantage over conventional methods where the hydrocarbon content is typically initially determined and, on the basis of this determined value, the tank ventilation process is subsequently carried out in accordance with a predefined sequence of operation. In contrast to the present invention, the related art does not provide for reversing the objective achieved by the tank ventilation process of regenerating the fuel vapor filter, which results over the course of the tank ventilation process in a reduction of the hydrocarbon content in the purge gas, in order to actuate the components, i.e., in particular the tank ventilation valve and/or the purge-gas feed device, that bring about the tank ventilation process.

An internal combustion engine according to the present invention has at least

- a combustion engine,
- a fresh gas line for feeding fresh gas to the combustion engine,
- a tank system equipped with at least
  - a fuel tank and
  - a fuel vapor filter, which is preferably connected fluid-conductively to an ambient orifice, allowing ambient air to be introduced into the fuel vapor filter via the ambient orifice, and
  - a vent line leading from the fuel tank to the fuel vapor filter, and
  - a purge gas line that leads from the fuel vapor filter to the fresh gas line of the internal combustion engine, and
  - a sensor that is suited or adapted for (directly or indirectly) determining a degree of hydrocarbon saturation of purge gas contained in the purge gas line, and
  - a tank ventilation valve that is integrated in the purge gas line, and/or
  - a purge-gas feed device.

In addition, an internal combustion engine according to the present invention includes a control device that is configured to implement a method according to the present invention in an automated manner.

A preferred embodiment of a method according to the present invention provides that a pressure sensor, which is preferably integrated in the purge gas line, and/or a lambda sensor (lambda probe), which is integrated in an exhaust-system branch of the internal combustion engine, and/or a hydrocarbon sensor, i.e., a sensor, which is able to directly ascertain a hydrocarbon content, be used as a sensor. When a pressure sensor is used, a hydrocarbon content of the purge gas may be inferred, in particular on the basis of a gradient of the pressure in the purge gas line, ascertained by the pressure sensor. Similarly to the use of a hydrocarbon sensor, this makes it possible for the hydrocarbon content of the purge gas to be predictively determined, i.e., before it enters via the fresh gas line into the combustion chamber(s) of the internal combustion engine, which, within the scope of a method according to the present invention, benefits the accuracy with which the quantity of the fuel fed to the combustion chamber(s) is adjusted. On the other hand, the advantage of using a lambda sensor to determine the hydrocarbon content is that a sensor that usually already exists in an internal combustion engine is used for this, which has a beneficial effect on the costs of manufacturing such an internal combustion engine according to the present invention. This is particularly the case when an internal combustion engine according to the present invention or that is used in accordance with the present invention, as preferably provided, includes a lambda controller, which is an apparatus, in particular a software-implemented device of the control device, which, on the basis of the measurement signal from the lambda sensor, regulates the quantities of the fuel introduced into the combustion chamber(s) of the internal combustion engine in such a way that a defined, generally more or less stoichiometric fuel-oxygen ratio is adjusted in the case of a spark-ignition combustion engine, taking into account the oxygen that is likewise introduced via the fresh gas into the combustion chambers.

A preferred embodiment of a method according to the present invention provides that ascertaining a value of the hydrocarbon content includes adding a previously determined hydrocarbon content value and a change value; the change value being derived from an instantaneous value measured by the sensor and a weighting value, in particular a weighting factor. The hydrocarbon content value may thereby be ascertained with exceptional accuracy, especially when it is not measured directly, rather is derived from other measured values that describe the operation of the combustion engine, for example, the oxygen content in the exhaust gas of the combustion engine.

It may also be thereby provided for the weighting value to be altered during the tank ventilation process, it being possible for this to be particularly a function of the opening angle of the tank ventilation valve (it being possible for the weighting value to become greater, in particular, with increasing opening angle) and/or of the level of the power control of the purge-gas feed device and/or of the time elapsed since the beginning of the tank ventilation process. This makes possible a high degree of accuracy for determining the hydrocarbon content, respectively with regard to the effects of the hydrocarbons introduced via the purge gas into the combustion chamber(s).

Upon implementation of a method according to the present invention, it may also be provided that the tank ventilation valve be opened and/or the purge-gas feed device be operated already prior to initiation of the tank ventilation process. It may also be thereby provided that the tank ventilation valve be opened and/or the purge-gas feed device be operated already prior to initiation of the tank ventilation process only when an operating temperature of the internal combustion engine is within a defined temperature range (for example, between 18° C. and 90° C.) and/or when the ambient temperature is above a limiting temperature (for example, 15° C., 25° C. or 35° C.) because a stable operating state of the internal combustion engine may then be assumed.

In accordance with the present invention, a tank ventilation process may always be or only be initiated when

- an operating temperature range (for example, >95° C.) of the internal combustion engine, in particular of a coolant of a cooling system thereof, is reached, and/or
- the combustion engine is operated in a normal operation, i.e., without temporary measures that influence the combustion processes in the combustion engine (for example, measures for increasing the exhaust-gas temperature with the aim of a most rapid possible heating of exhaust gas aftertreatment devices integrated in an exhaust-system branch of the internal combustion engine), and/or
- an initial on-board diagnosis, i.e., an automatic system control implemented following a start of the internal combustion engine, is concluded.

Preferably, the hydrocarbon content may be ascertained and the tank ventilation valve and/or the purge-gas feed device actuated as a function of the same start condition(s) for the tank ventilation process. This ensures the best possible system availability.

It may be provided in accordance with a preferred embodiment of a method according to the present invention that a predefined actuation of the tank ventilation valve and/or of the purge-gas feed device be performed once on the basis of a predefined value, in particular a predefined value curve of the hydrocarbon content, in a first tank ventilation process of an operating cycle of the internal combustion engine (i.e., a period of time of an uninterrupted initial operation of the combustion engine, which does not necessarily require an uninterrupted operation of the combustion engine) for a preferably applicable lead time. This may serve to remove gases still contained in the purge gas line to prevent these gases from corrupting a subsequent tank ventilation process, respectively the compensation of such a tank ventilation process with regard to the fuel introduced into the combustion chamber(s).

It may preferably be provided that the tank ventilation valve be actuated on the basis of a pulse-width modulation (PWM). This makes it possible, for example, for digital circuits (for example, microcontrollers) to be used, which are only able to produce switched signals, to actuate a tank ventilation valve, which is to be actuated in an analog manner.

The method according to the present invention may be used, in particular, for a fuel tank system of an internal combustion engine whose combustion engine is a spark-ignition engine and, in particular, operable in accordance with the Otto combustion principle, because fuel used for operating such a combustion engine is generally highly volatile (especially in comparison to Diesel fuel), justifying the particular need for an evaporative emission control.

An internal combustion engine according to the present invention may, in particular be part of a motor vehicle. The combustion engine of the internal combustion engine may be provided, in particular for directly or indirectly supplying motive power to the motor vehicle. For that reason, the present invention also relates to a motor vehicle, in particular a wheel-based and non-rail motor vehicle (preferably, a passenger vehicle or a truck) having an internal combustion engine according to the present invention.

In accordance with the present invention, the designation "fuel vapor filter" does not necessarily imply that it must filter the volatile fuel in gaseous form. Rather, the fuel may also already be (partially) condensed out again during the filtering.

The indefinite articles ("a," "an," "of a," and "of an") are to be understood as such, and not as numerals, particularly in the Patent Claims and in the Specification that explains the Patent Claims in general terms. Thus, components that are specified in accordance therewith are to be understood as being present at least once and possibly multiple times.

BRIEF DESCRIPTION OF THE DRAWINGS

The present invention is explained in greater detail in the following on the basis of exemplary embodiments illustrated in the drawing. In the drawing:

FIG. 3 is a graphic representation for illustrating the implementation of a method according to the present invention in accordance with a second specific embodiment;

FIG. 4 is a graphic representation for illustrating the implementation of a method according to the present invention in accordance with a third specific embodiment.

DETAILED DESCRIPTION OF THE INVENTION

Figure 1:
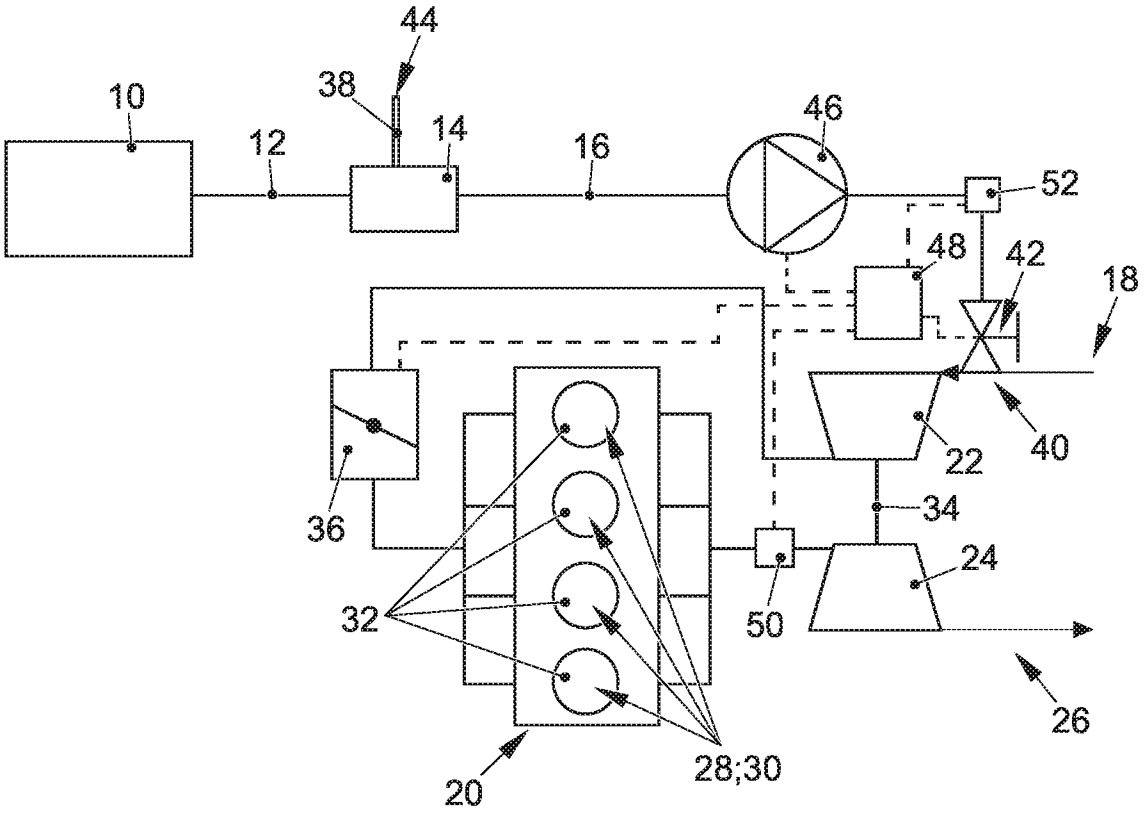
FIG. 1 is a schematic view of an internal combustion engine according to the present invention equipped with a fuel tank system.

FIG. 1 depicts an internal combustion engine according to the present invention for a motor vehicle having a fuel tank system. It includes a fuel tank 10, which is connected via a vent line 12 to a fuel vapor filter 14, which may, in particular be in the form of an activated-carbon filter or at least be equipped therewith. Furthermore, fuel vapor filter 14 is connected via a purge gas line 16 to a fresh gas line 18 of the internal combustion engine; purge gas line 16 leading into fresh gas line 18 upstream (relative to the direction of flow of fresh gas in fresh gas line 18 toward a combustion engine 20 of the internal combustion engine) of a charge-air compressor 22 integrated in fresh gas line 18. Charge-air compressor 22 is part of an exhaust-gas turbocharger, which, furthermore, includes an exhaust-gas turbine 24 that is integrated in an exhaust-system branch 26 of the internal combustion engine. Also provided in the charge air path of fresh gas fresh gas line 18 disposed between charge-air compressor 22 and combustion engine 20 is a throttle valve 36 which divides the charge air path into an upstream section, often referred to as a pressure pipe, and a downstream section, often referred to as an intake manifold.

Mixture quantities, which are composed of fresh gas, that is completely or essentially composed of ambient air, as well as of fuel that is injected, for example, directly by injection valves (not shown), are combusted in a generally known manner during operation of the internal combustion engine, in a defined sequence, in combustion chambers 28 of combustion engine 20, which are partially bounded by cylinders 30 of combustion engine 20; the thereby generated pressure increases in combustion chambers 28 being used to move pistons 32 that are guided longitudinally axially in cylinders 30. These movements of pistons 32 are converted into a rotary motion of a crankshaft (not shown) with the interposition of piston rods (not shown); the guiding of pistons 32 by the crankshaft via the piston rods simultaneously leading to a cyclical reciprocating movement of pistons 32. The exhaust gas produced during the combustion of the fresh gas-fuel mixture quantities in combustion chambers 28 is dissipated via exhaust-system branch 26 and thereby flows through exhaust-gas turbine 24, leading to a rotational driving of a turbine wheel (not shown). This rotation of the turbine wheel is transmitted by a shaft 34 to a compressor rotor (not shown) of charge-air compressor 22, whereby charge-air compressor 22 compresses the fresh gas to be supplied via fresh gas line 18 to combustion engine 20.

Via the side thereof facing away from vent line 12 and purge gas line 16 (relative to the filtering action thereof for fuel vapors), fuel vapor filter 14 of the fuel tank system communicates gas-conductively with the ambient environment via an ambient air line 38; ambient air line 38 forming an ambient orifice 44 for that purpose.

Fuel tank 10 is partially filled with liquid fuel, a portion of this fuel being typically vaporized, so that fuel in the gaseous aggregation state is also present in fuel tank 10. Such a vaporization of fuel in fuel tank 10 is intensified by a relatively high temperature of the fuel, which may be the case, in particular, at comparatively high ambient temperatures, as well as in response to a change in the ambient pressure, caused, for example, by an uphill driving of a motor vehicle equipped with the internal combustion engine. To avoid an excessively high overpressure in fuel tank 10 caused by such a vaporization, it is possible to equalize the pressure to the ambient pressure via vent line 12 and fuel vapor filter 14, as well as via ambient air line 38, fuel vapor filter 14 making it possible to prevent such a pressure equalization from resulting in fuel vapors escaping to the ambient environment.

Such a venting of fuel tank 10 results in an increasing saturation of fuel vapor filter 14, which, in turn, necessitates regenerating the same in regular intervals. To this end, it is provided that fuel vapor filter 14 be purged by drawing in ambient air via ambient air line 38 and ambient orifice 44. This ambient air flows through fuel vapor filter 14 in the direction opposite that of the through-flow for venting fuel tank 10, whereby fuel molecules absorbed in fuel vapor filter 14 are entrained by the ambient air and delivered via purge gas line 16 into fresh gas line 18. This fuel is thereby fed to a combustion in combustion chambers 28 of combustion engine 20.

Such a purging of fuel vapor filter 14 is provided merely periodically and always during operation of combustion engine 20 because, only then, may the fuel introduced into fresh gas line 18 by the purging of fuel vapor filter 14 also be reliably fed to a combustion in combustion chambers 34. On the other hand, an introduction into fresh gas line 18 during a non-operation of combustion engine 20 could cause the gaseous fuel to escape into the ambient environment via leaks in fresh gas line 18 and, in particular, via an intake opening of fresh gas line 18.

Integrated in purge gas line 16 is a tank ventilation valve 42 that is located as closely as possible to orifice 40 of purge gas line 16 in fresh gas line 18 or is integrated therein.

Purging fuel vapor filter 14 requires a sufficient pressure differential between the ambient pressure, on the one hand, and the pressure prevailing in fresh gas line 18 in the area of orifice 40 of purge gas line 16, on the other hand. This pressure differential is not always present due to strongly fluctuating pressures in fresh gas line 18 during an operation of combustion engine 26. During an operation of combustion engine 20 and thus of charge-air compressor 22, the pressure of the fresh gas in the portion of fresh gas line 18 in the area of orifice 40 of purge gas line 16 is mostly so low that a sufficient pressure differential is present relative to the ambient pressure existing at ambient orifice 44. However, this is not always the case.

To make possible a purging of fuel vapor filter 14 at any time in order to reliably prevent a complete saturation of the same, the fuel tank system of the internal combustion engine also includes a purge-gas feed device 46, which is integrated in purge gas line 16, may also be normally referred to as "purge air pump," and may be designed in the form of a piston-type compressor, then, in particular, as a vane-type compressor, or as a radial fan. Operating this purge-gas feed device 46 makes it possible to actively draw in ambient air via ambient orifice 44 and ambient air line 38, which then flows through fuel vapor filter 14 for the purging thereof and is fed via purge-gas feed device 46 up to orifice 40 of purge gas line 16.

At least purge-gas feed device 46, tank ventilation valve 42, throttle valve 36, and the injection valves are actuable by a control device 48 (for example, the engine management of the internal combustion engine). This actuation thereby takes place at least partially as a function of measured values of a lambda sensor 50 integrated in exhaust-system branch 26 and/or of a pressure sensor or hydrocarbon sensor 52 integrated in purge gas line 16.

In accordance with the present invention, the hydrocarbon content, i.e., the content of hydrocarbons contained in purge gas line 16, respectively of the purge gas flowing therethrough, is continuously determined during a tank ventilation process and is utilized to actuate tank ventilation valve 42 and/or purge-gas feed device 46 to influence the quantity of the hydrocarbons entrained by the purge gas via fresh gas line 18 into combustion chambers 28 of combustion engine 20, which act as fuel. At the same time, control device 48 doses the fuel additionally introduced by the injection valves into combustion chambers 28 in such a way that a possibly changing setpoint value for the fuel-oxygen ratio of the combustion gases in combustion chambers 28 and thereby also an oxygen ratio in the exhaust gas created upon combustion of these combustion gases is substantially maintained. Accordingly, control device 48 is also used as a lambda controller of the internal combustion engine.

Exhaust gas, which is formed during combustion of the fuel-fresh gas mixture quantities in combustion chambers 28 of combustion engine 20, flows around lambda sensor 50, which is integrated in exhaust-system branch 26 and subsequently produces a measurement signal indicative of the proportion of residual oxygen in the exhaust gas. This measurement signal is transmitted to control device 48, which uses it both in the function thereof as a lambda controller, as well as in the function thereof as a regulating device for evaporative emission control, respectively for actuating purge-gas feed device 46 and tank ventilation valve 42. It may be provided that both the absolute value of the measurement signal of lambda sensor 50, as well as a correction value, determined by control device 48 in the function thereof as a lambda controller, be transmitted to control device 48 in the function thereof as a regulating device for evaporative emission control, to actuate the injection valves and, if indicated, also throttle valve 36 anew, respectively in a modified form, on the basis of the measurement signal of lambda sensor 50, to observe a defined fuel-oxygen ratio of the fuel-fresh gas mixture quantities, which are combusted in combustion chambers 28. On the basis of these input quantities, control device 48, in the function thereof as a regulating device for evaporative emission control, computes actuation signals for purge-gas feed device 46 and tank ventilation valve 42. By appropriately driving purge-gas feed device 46 and suitably adjusting the opening angle of tank ventilation valve 42, the quantity of the purge gas introduced into the fresh gas line 18 is influenced, which, in turn, influences the fuel introduced on the whole, i.e., via the injection valves, on the one hand, and via the fresh gas into combustion chambers 28, on the other hand.

Figure 5:
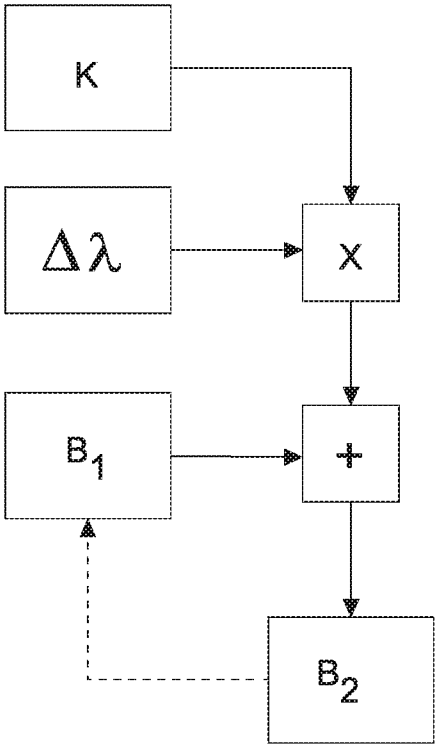
FIG. 5 is a graphic representation for illustrating the ascertainment of the hydrocarbon content of the purge gas in the course of implementing a method according to the present invention.

In accordance with FIG. 5, ascertaining a hydrocarbon content value $B_2$ includes adding a previously determined hydrocarbon content value $B_1$, a change value, which is derived from the value that is a function of the instantaneous value measured by sensor 50, 52, and a weighting value, specifically a weighting factor K. In FIG. 5, weighting factor K is specifically combined with, respectively multiplied by a value $\Delta\lambda$, that is indicative of a deviation of the setpoint value for the fuel-oxygen ratio currently predefined by the lambda controller.

Figure 2:
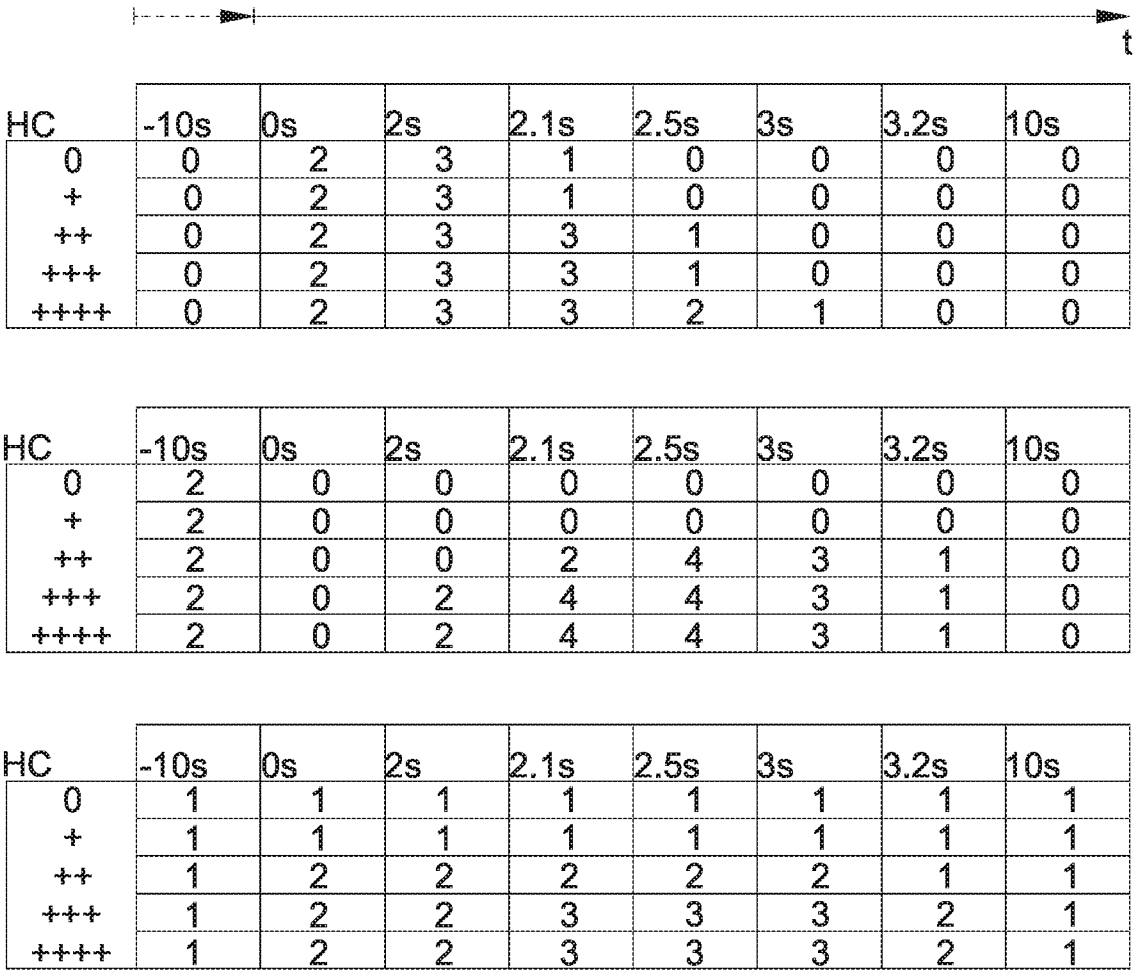
FIG. 2 is a graphic representation for illustrating the implementation of a method according to the present invention in accordance with a first specific embodiment.

In generally the same graphic representations, FIG. 2 through 4 illustrate the procedure for carrying out a method according to the present invention in accordance with various specific embodiments. The graphic representations thereby each show three tables, of which the upper assigns specific weighting factors K (from 0 to 3) to specific links of the hydrocarbon content to time intervals of a tank ventilation process. The chronological sequence of the tank ventilation process thereby extends from left to right along the columns, starting from the start value zero seconds (0 s). The earlier interval represents a lead time, while a predefined actuation of tank ventilation valve 42 and of purge-gas feed device 46 is carried out once on the basis of a predefined value of the hydrocarbon content during a first tank ventilation process in an operating cycle of the internal combustion engine. During this lead time, weighting factor K is always set to zero. On the other hand, the rows in the table reflect the different degrees of saturation of the purge gas with hydrocarbons, respectively different hydrocarbon contents; no saturation being denoted by a zero, a small degree of saturation by a plus sign, a slight degree of saturation by two plus signs, a medium degree of saturation by three plus signs, and a high degree of saturation by four plus signs.

In each case, the middle table links specific opening angles of tank ventilation valve 42 to the same time intervals of the tank ventilation process as the upper table; the opening angles ranging from zero, in accordance with a completely closed state, to five, in accordance with a state that is open completely, respectively to the greatest extent possible.

In each case, the bottom table links specific performance states of purge-gas feed device 46; the performance states ranging from zero in accordance with a non-operation of purge-gas feed device 46 to three in accordance with an operation of purge-gas feed device 46 at maximum power, respectively driving speed.

In accordance with FIG. 2, the recording of the degree of hydrocarbon saturation may be temporally coupled to the components participating in a tank ventilation process (in particular, tank ventilation valve 42 and purge-gas feed device 46), the learning of the hydrocarbon content for the duration of the tank ventilation process being varied to match a predefined actuation of the tank ventilation components. In accordance with FIG. 2, this predefined actuation of the tank ventilation components thereby includes first carefully opening tank ventilation valve 42, then more rapidly opening the same while simultaneously actuating purge-gas feed device 46, prior to final closing of tank ventilation valve 42.

In a predefined actuation of the tank ventilation components, in accordance with FIG. 3, the hydrocarbon content may be constantly, respectively steadily learned over the duration of a tank ventilation process, i.e., the same weighting factor is always considered during different actuation processes.

In accordance with FIG. 4, the process of learning the hydrocarbon content may take place predominantly at the beginning of a tank ventilation process while the tank ventilation components are simultaneously subject to a relatively limited actuation. In the further course, only a very limited learning progress or even no learning progress at all is then still provided while the tank ventilation components are actuated correspondingly.

LIST OF REFERENCE NUMERALS

10 fuel tank
12 venting line
14 fuel vapor filter
16 purge gas line
18 fresh gas line
20 combustion engine
22 charge-air compressor
24 exhaust-gas turbine
26 exhaust-system branch
28 combustion chamber of the combustion engine
30 cylinder of the combustion engine
32 piston of the combustion engine
34 shaft
36 throttle valve
38 ambient air line
40 orifice of the purge gas line
42 tank ventilation valve
44 ambient orifice
46 purge-gas feed device
48 control device
50 lambda sensor
52 pressure sensor or hydrocarbon sensor in the purge gas line

The invention claimed is:

1. A method for operating an internal combustion engine comprising a combustion engine,
a fresh gas line, and
a fuel tank system equipped with
a fuel tank, and
a fuel vapor filter, and
a purge gas line that connects the fuel vapor filter to the fresh gas line, and
a sensor that is suited for determining a degree of hydrocarbon saturation of purge gas contained in the purge gas line, and
a tank ventilation valve that is integrated in the purge gas line, and/or
a purge-gas feed device;
wherein in response to a control device of the internal combustion engine that is connected by control technology to the tank ventilation valve and/or the purge-gas feed device, a tank ventilation process is initiated, as needed, for which the purge-gas feed device is operated, and/or the tank ventilation valve is opened; for the tank ventilation process, a hydrocarbon content of the purge gas being ascertained using the sensor; fuel, which is introduced into a combustion chamber of the combustion engine being dosed as a function of the ascertained hydrocarbon content,
wherein the hydrocarbon content is continuously determined during the tank ventilation process and is utilized to actuate the tank ventilation valve and/or the purge-gas feed device.

2. The method as recited in claim 1, wherein a pressure sensor and/or a hydrocarbon sensor is used as sensor.

3. The method as recited in claim 1, wherein ascertaining a hydrocarbon content value includes adding a previously determined hydrocarbon content value and a change value; the change value being derived from an instantaneous value measured by the sensor and a weighting value.

4. The method as recited in claim 3, wherein the weighting value is altered during the tank ventilation process.

5. The method as recited in claim 4, wherein the weighting value is a function of the opening angle of the tank ventilation valve and/or of the level of the power control of the purge-gas feed device and/or of the time elapsed since the beginning of the tank ventilation process.

6. The method as recited in claim 1, wherein the tank ventilation valve is opened and/or the purge-gas feed device is operated already prior to initiation of the tank ventilation process.

7. The method as recited in claim 6, wherein the tank ventilation valve is opened and/or the purge-gas feed device is operated already prior to initiation of the tank ventilation process only when an operating temperature of the internal combustion engine is within a defined temperature range and/or the ambient temperature is above a limiting temperature.

8. The method as recited in claim 1, wherein a tank ventilation process is initiated when an operating temperature range of the internal combustion engine is reached, and/or the combustion engine is operated in a normal operation, and/or an initial on-board diagnosis is concluded.

9. The method as recited in claim 1, wherein the ascertainment of the hydrocarbon content and the actuation of tank ventilation valve and/or of the purge-gas feed device are carried out as a function of the same start condition(s) for the tank ventilation process.

10. The method as recited in claim 1, wherein a predefined actuation of the tank ventilation valve and/or of the purge-gas feed device is carried out for a lead time on the basis of a predefined value of the hydrocarbon content, once during a first tank ventilation process in an operating cycle of the internal combustion engine.

11. An internal combustion engine comprising a combustion engine, a fresh gas line, and a fuel tank system equipped with a fuel tank, and a fuel vapor filter, and a purge gas line that connects the fuel vapor filter to the fresh gas line, a sensor that is adapted for determining a degree of hydrocarbon saturation of purge gas contained in the purge gas line, and a tank ventilation valve that is integrated in the purge gas line, and/or a purge-gas feed device, and a control device that is connected by control technology to the tank ventilation valve and/or to the purge-gas feed device, wherein the control device is configured for carrying out the method according to claim 1.

12. The internal combustion engine as recited in claim 11, wherein a pressure sensor and/or a hydrocarbon sensor is used as the sensor.

13. The internal combustion engine as recited in claim 11, wherein the combustion engine can be operated with spark ignition.

14. The method as recited in claim 2, wherein the pressure sensor and/or the hydrocarbon sensor is integrated in the purge gas line.

15. The method as recited in claim 1, wherein a lambda sensor is used as the sensor.

16. The internal combustion engine as recited in claim 12, wherein the pressure sensor and/or the hydrocarbon sensor is integrated in the purge gas line.

17. The internal combustion engine as recited in claim 11, wherein a lambda sensor is used as the sensor.

* * * * *